United States Patent [19]

Lundblad et al.

[11] 4,232,533

[45] Nov. 11, 1980

[54] MULTI-STAGE ECONOMIZER

[75] Inventors: James T. Lundblad, Onalaska; Chester D. Ware, La Crosse, both of Wis.

[73] Assignee: The Trane Company, La Crosse, Wis.

[21] Appl. No.: 53,578

[22] Filed: Jun. 29, 1979

[51] Int. Cl.[3] ..... F25B 39/04

[52] U.S. Cl. ..... 62/509; 62/512

[58] Field of Search ..... 62/115, 498, 509, 510, 62/512

[56] References Cited

U.S. PATENT DOCUMENTS

| | | | |
|---|---|---|---|
| 2,164,761 | 7/1939 | Ashley | 62/115 |
| 2,277,647 | 3/1942 | Jones | 62/115 |
| 3,553,974 | 1/1971 | Osborne | 62/512 |

*Primary Examiner*—Ronald C. Capossela
*Attorney, Agent, or Firm*—Carl M. Lewis; Peter D. Ferguson; Ronald M. Anderson

[57] ABSTRACT

An economizer is disclosed having a plurality of stages for flash cooling refrigerant liquid for use in a refrigeration system. The refrigerant liquid is cooled by evaporation of a portion of the liquid as it passes through throttling means into chambers of successively lower pressure. Sump means are provided to collect the refrigerant liquid flowing between the chambers. As the refrigerant enters each chamber, it is deflected by distribution means, thereby effecting more efficient separation of the flashed refrigerant vapor from the resulting liquid spray.

15 Claims, 7 Drawing Figures

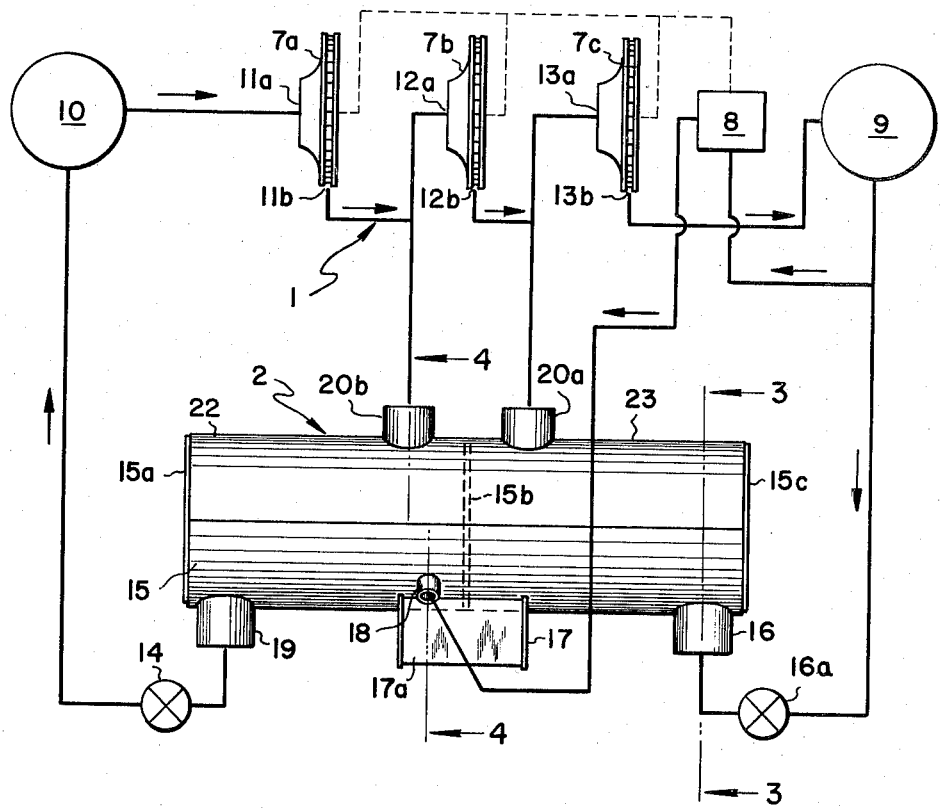
FIG. 1
FIG. 2
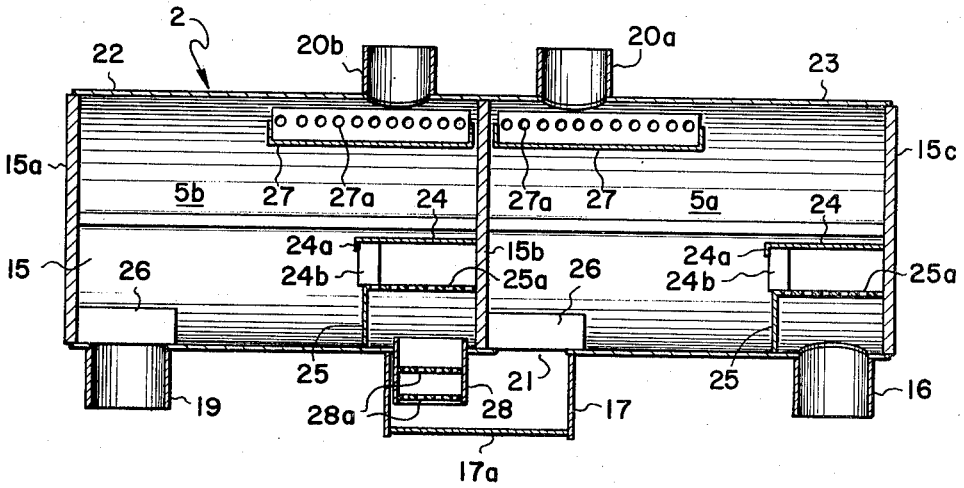

MULTI-STAGE ECONOMIZER

TECHNICAL FIELD

The subject invention is concerned generally with an economizer having a plurality of stages for flash cooling a refrigerant liquid, and specifically with an economizer for use in a refrigeration system having stages of compression at three or more pressures.

BACKGROUND ART

An economizer is typically utilized between the condenser and the evaporator of a refrigeration system to cool refrigerant liquid below the temperature at which it leaves the condenser in order to improve the operating efficiency of the system. Flash cooling is achieved by the evaporation of part of the refrigerant liquid as it flows from the condenser through nozzles, orifices, or other pressure reducing means into a chamber which is lower in pressure. The flashing refrigerant cools the remaining liquid by absorbing heat as it vaporizes.

Upon separation from the cooled liquid, the refrigerant vapor, or flash gas, is conveyed to the inlet of a compressor stage operating at intermediate pressure. The cooled refrigerant liquid flows from the economizer to an evaporator, where it is vaporized in heat exchange relationship with another fluid, e.g., water, to satisfy a cooling load.

Refrigerant vapor leaving the evaporator is typically compressed in two stages. After the first stage of compression, it is mixed with the flash gas from the economizer and further compressed, and returned to the condenser to repeat the cycle.

Although an economizer can be used with virtually any refrigeration system in which multiple stages of compression are provided, its use is economically justified only if the overall system cost is thereby reduced, or if the resulting energy savings payback exceeds its cost. Multiple economizer stages generally are not used because there are few refrigeration systems designed with more than two compressor stages, and because a second economizer stage of the prior art design typically cannot be cost justified due to the declining rate of return, i.e., two stages of economizing are less than twice as efficient as one, yet are almost twice as expensive when separate vessels are used for each stage.

It has long been recognized in the art that efficient separation of the flash gas from the cooled refrigerant liquid is essential to efficient operation of an economizer. The violent expansion of the refrigerant as it flashes and rushes into the economizer chamber tends to entrain liquid droplets in the vapor. Various means have been developed to separate the liquid from the vapor, including relatively expensive eliminator screen grids. It is also possible to minimize liquid entrainment in the leaving vapor by distributing the entering refrigerant liquid over a large volume and directing it away from the flash gas outlet. However, previous distribution apparatus designed for this purpose have been somewhat complicated and expensive to fabricate.

Taking the above considerations into account, the present invention is designed to reduce the complexity and part count sufficiently to permit a two stage economizer to be built at substantially less cost than two single stage economizers of prior art design. The resulting multi-stage economizer operates over a wide capacity range, and provides improved efficiency in a compact size.

The following U.S. Pat. Nos. describe prior art relevant to the subject invention.

U.S. Pat. No. 2,277,647 discloses the basic economizer design, in which the flow of refrigerant into a flash chamber is controlled by a float valve. The cooled liquid refrigerant runs out the bottom of the flash chamber and into another chamber containing a second float valve controlling its entry into an evaporator. An eliminator screen is used to separate the liquid from the flash gas before it is conveyed to the second stage of a two stage compressor.

A perforate distributor means is shown in U.S. Pat. No. 3,553,974 for effecting more efficient separation of the liquid refrigerant from the vapor as it expands into a flash chamber. A float valve is used to modulate the flow of refrigerant as a function of cooling load, so that the liquid level is always above the entrance to the perforate distributor means.

U.S. Pat. No. 2,164,761 discloses a two stage economizer in which refrigerant liquid is accumulated in vertical chambers to exert a hydrostatic head pressure in response to load, thereby controlling the flow of refrigerant into an evaporator.

DISCLOSURE OF THE INVENTION

The subject invention is an economizer having a plurality of stages for flash cooling refrigerant liquid for use in a refrigeration system. Housing means define a plurality of chambers of successively lower pressure such that a first chamber is at the highest pressure and a last chamber is at the lowest pressure. First inlet means convey a refrigerant fluid into the first chamber and first outlet means convey the cooled refrigerant liquid out of the last chamber.

Second inlet means and second outlet means are operative to convey refrigerant into each of the chambers except the first and out from each of the chambers except the last, respectively. The second outlet means of a chamber of relatively higher pressure are connected to the second inlet means of a chamber of successively lower pressure by connecting means. Sump means are included for collecting the refrigerant liquid which flows through the connecting means.

The flow of refrigerant into each chamber is restricted by throttling means. The throttling means reduce the pressure of the refrigerant liquid so that it flashes or evaporates as it flows through the restriction into the lower pressure chamber, thereby cooling the liquid refrigerant. Evaporated refrigerant or flash gas is conveyed away from each chamber by flash gas outlet means disposed near the top of each chamber. Simple baffle means are operative to reduce the entrainment of the refrigerant liquid in the vapor flowing through said flash gas outlet means.

Distributor means disposed above the first and second inlet means direct the entering refrigerent into each chamber in a generally horizontal direction, and include a deflector plate with one edge turned down into the flow path to deflect the vapor/liquid mixture, thereby causing efficient separation of the two in the resulting liquid spray.

An object of this invention is to minimize the fabrication costs of a multi-stage economizer for use in a refrigeration system by greatly reducing its part count and by simplifying its construction.

Another object of this invention is to improve the cycle efficiency of the refrigeration system with which this invention is used in excess of that provided by use of an economizer typical of those previously known in the art.

A further object of this invention is to provide an economizer with flexibility to handle large capacity variations.

Still a further object of this invention is to provide inexpensive means for separating the refrigerant liquid from the flash gas in a relatively small, compact volume.

These and other objects of the present invention will become apparent from the following description of two preferred embodiments and by reference to the accompanying drawings.

BRIEF DESCRIPTION OF THE DRAWINGS

FIG. 1 shows the subject multi-stage economizer connected into a refrigeration system.

FIG. 2 is a cross-sectional view taken along the longitudinal axis of the first embodiment of the present invention.

DESCRIPTION OF THE PREFERRED EMBODIMENTS

Figure 3:
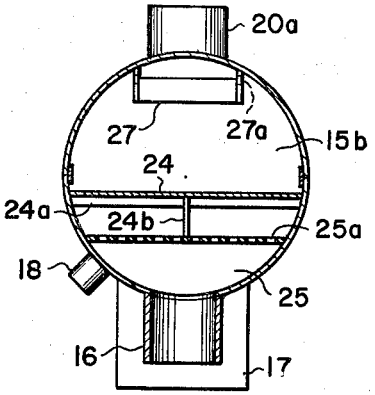
FIG. 3 is a transverse cross-sectional view taken along section line 3—3 of FIG. 1.

Referring to FIG. 1, the first embodiment of the present invention is shown connected into a refrigeration system in which a motor 8 drives a multi-stage centrifugal compressor 1. Compressor 1 has three stages 7*a*, 7*b*, and 7*c* of successively higher inlet pressure connected in cascade fashion such that outlet 11*b* from the lowest pressure stage 7*a* is connected to inlet 12*a* of the intermediate pressure stage 7*b*, and outlet 12*b*, of stage 7*b* is connected to inlet 13*a* of the highest pressure stage 7*c*.

Compressed refrigerant vapor from outlet 13*b* of stage 7*c* flows to condenser 9, where it is condensed to a liquid. The economizer, denoted generally by reference numeral 2, is connected to receive the condensed refrigerant liquid through throttle means 16*a* disposed upstream of first inlet means 16. As the liquid passes through the throttle means 16*a*, a portion of it flashes or vaporizes, thereby cooling the remaining liquid. It should be understood that throttling means 16*a* could be disposed within inlet means 16, or could be a float level metering valve.

The liquid refrigerant is further cooled in a second economizer stage as will be explained below in greater detail, and flows out of the economizer through first outlet means 19. After exiting the economizer, the cooled refrigerant liquid passes through evaporator throttle means 14 and into evaporator 10, where it is vaporized in heat exchange relationship with another fluid such as water or a mixture of water and ethylene glycol, to meet a cooling demand. Thereafter, the vaporized refrigerant is returned to the inlet 11*a* of the lowest pressure compressor stage 7*a*, to repeat the cycle.

A small amount of the condensed refrigerant liquid is diverted before entering the economizer, for use in cooling the motor 8. After circulating through motor 8, the partially vaporized refrigerant re-enters the refrigeration cycle mainstream through motor coolant return inlet 18, disposed near the lower center of the economizer.

Flash gas from flash gas outlet means 20*a* and 20*b* is separately conveyed to compressor inlets 13*a* and 12*a*, to provide for compression of the flash gas in compressor stages 7*c* and 7*b*, respectively. It should be apparent to those skilled in the art, that flash gas from successively lower pressure stages of the economizer is compressed by cascaded compressor stages of successively lower inlet pressure to reduce the total energy required by the compression cycle for a given amount of cooling. Since only part of the refrigerant is compressed in the lowest and intermediate pressure stages 7*a* and 7*b* of compressor 1, the system efficiency is dramatically improved. For example, in a refrigeration system rated for 300 tons cooling capacity, it is estimated that the present invention reduces energy consumption approximately 11% compared to that system operating at the same cooling capacity without an economizer.

Figure 4:
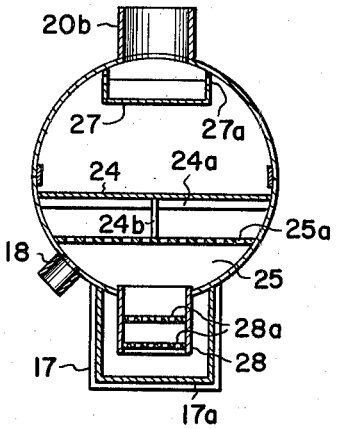
FIG. 4 is a transverse cross-sectional view taken along section line 4—4 of FIG. 1.

Referring now to FIGS. 2–4, the structure and operation of the first embodiment of the present invention will be discussed in greater detail. The economizer 2 is defined in the shape of an elongated cylinder by housing means which include a lower half-shell 15, and two upper sections 22 and 23. Sections 22 and 23 are identical in structure, however, they abut end to end in symmetrically opposite relationship relative to the position of flash gas outlet means 20*a* and 20*b*. The housing means further include partition means 15*a*, 15*b*, and 15*c* arranged transversely to the longitudinal axis of economizer 2 and sealingly welded to the shell sections 15, 22, and 23 so as to define two separate chambers 5*a* and 5*b*. For purposes of the preferred embodiments which have only two economizer stages, chamber 5*a* is the first chamber and chamber 5*b* is the last. First inlet means 16 and first outlet means 19 extend below the lower half-shell 15, from circular cutouts near each end. The flash gas outlet means 20*a* and 20*b* extend above circular cutouts in the upper sections 23 and 22 respectively, near and at each side of the center partition means 15*b*. This configuration minimizes the length and complexity of tubing layout required to connect the flash gas outlet means 20*a* and 20*b* to the compressor 1.

Second outlet means 21 are disposed in the form of a circular cutout in the bottom of chamber 5*a* on one side of partition means 15*b*, and on the other side, second inlet means 28 extends down below a circular cutout in chamber 5*b*. Connecting means 17 provide a rectangular shaped sealed connection around the second outlet means 21 and second inlet means 28, and include sump means 17*a* depending therebelow.

Inside chambers 5*a* and 5*b*, distributor means comprising distributor plate 25 and deflector plate 24 are disposed above the first and second inlet means 16 and 28, respectively. The top of distributor plate 27 is perforated with a plurality of holes 25*a*. Deflection plate 24 has one edge 24*a* turned down transversely across the axis of the economizer 2, and is supported at its center near this edge by a vertical brace 24*b*, extending up from and attached to distribution plate 25. First and second outlet means 19 and 21 are each bisected by a metal plate welded in place on edge to act as a vortex breaker 26.

Rectangular shaped baffle means 27 are disposed immediately below flash gas outlet means 20*a* and 20*b*. The sides of baffle means 27 are welded to the concave inner surface of sections 22 and 23 along lines parallel to their longitudinal axes, and are perforated with a plurality of relatively large diameter holes 27*a* on their vertical sides. The joints between the vertical sides and ends of baffle means 27 are not sealed by welding or by other means, but are left open to reduce construction costs.

In constructing the subject invention, partition means 15*a*, 15*b*, and 15*c* are positioned vertically with respect to the lower shell 15 and welded in place as shown. The vortex breaker plates 26 and distribution means are welded in place inside the lower shell 15, and baffle means 27 are welded in place insde sections 22 and 23. Sections 22 and 23 are then positioned and welded in place atop the lower shell 15.

By changing the orifice dimension in throttle means comprising orifice plates 16*a* and 28*a*, an economizer 2 of the same dimensions may be used with refrigeration units of different rated cooling capacity. For example, the same size economizer may be used in refrigeration systems in the range 900 tons through 1250 tons cooling capacity. For this reason, it is anticipated that only a very few different size economizers would be required to meet a wide range of cooling requirements. To minimize stock requirements, connecting means 17 and 17*a* would not be welded in place on such economizers until orifice plates 28*a* having a plurality of perforations of a predetermined diameter and number were installed for use in a refrigeration system of a particular cooling capacity. It will also be appreciated that sections 22 and 23 are interchangeable by rotation end for end, and that internal structures of chambers 5*a* and 5*b* are identical and are simple in form. It should be apparent that the resultant minimal parts count and simplified construction substantially reduce the cost of the present invention compared Each chamber 5*a* and 5*b* of the economizer can be thought of as divided into three operational zones: a separation zone wherein flash gas is separated from the refrigerant liquid; a liquid collection zone near the bottom of each chamber, for collecting the refrigerant liquid after it is substantially separated from said flash gas; and a gas collection zone near the top of each chamber, for collecting the flash gas so separated. The three zones are stacked vertically, extending in layers across each chamber. The spacial distinction between the separation zone and the collection zones promote the efficient operation of the subject economizer as will be explained below.

Operation of the first embodiment of the subject economizer is as follows. Refrigerant liquid from condenser 9 flows through orifice plates 16*a*, which are operative to partially restrict the flow and thereby to maintain a significant pressure drop between condenser 9 and chamber 5*a*. Part of the liquid refrigerant flashes as it passes through orifice plates 16*a*, cooling the remaining refrigerant liquid. The flashing action is relatively violent and the resulting mixture of refrigerant liquid and vapor enters first inlet means 16 with considerable turbulence. The mixture passes through holes 25*a* in distribution plate 25 and is deflected back and into chamber 5*a* in a generally horizontal direction by deflector plate 24. As the mixture strikes the turned down edge 24*a* of deflector plate 24, the resulting liquid spray fans out across the width of the lower shell 15 and the separation of refrigerant vapor from the liquid is thereby greatly facilitated. The volume extending through the chamber from above the top of the distribution plate 25 and from below the deflector plate 24 constitutes the lower half of the layer referred to as the separation zone. The elevation of the separation zone above the liquid collection zone, and specifically the elevation of this volume provides space for the flash gas to disengage the liquid stream and avoids the churning re-entrainment of the flash gas into the separated collected liquid.

Baffle means 27 are disposed in the gas collection zone and operate to further reduce the entrainment of refrigerant liquid in the exiting flash gas. The velocity of the flash gas is relatively high inside flash gas outlet means 20*a*, and baffle means 27 disperse this high velocity flow over a relatively large horizontal area in the gas collection zone so that flash gas approaches holes 27*a* and the open end of baffle means 27 at a relatively low flow velocity, thereby avoiding the "sucking" of refrigerant liquid droplets into flash gas outlet means 20*a*.

Flash gas is therefore separated from the refrigerant liquid as it flows through the partially open ends of baffle means 27 or through the holes 27*a* and out through vapor outlet means 20*a*. The flash gas thereafter mixes with the refrigerant vapor flowing from outlet 12*b* of the intermediate compressor stage 7*b*, for compression by stage 7*c*. It necessarily follows that the pressure at inlet 13*a* of compressor stage 7*c* must be approximately equal to but slightly less than the pressure in chamber 5*a*.

Vortex breaker plate 26 is disposed in the liquid collection zone and prevents the formation of a fluid vortex in the liquid which would otherwise reduce its rate of flow through second outlet means 21. Refrigerant liquid flows therethrough into connecting means 17, collecting in sump means 17*a* to a depth somewhat higher than the bottom edge of second inlet means 28; however, there is no well defined liquid level. At cooling loads much less than rated capacity, flash gas is entrained in the refrigerant liquid in small quantities, in a homogenous mixture. At lower loads, the percentage of flash gas in the mixture increases. The bottom edge of second inlet means 28 efflects at least a partial seal with the refrigerant liquid collected in sump means 17*a* over a rather wide range of cooling load, avoiding significant flash gas bypass into second inlet means 28. The considerable turbulence of the refrigerant fluid prevents a complete vapor seal until the cooling load exceeds rated capacity by approximately 10%, at which point the bottom edge of second inlet means 28 is substantially immersed in refrigerant liquid.

From sump means 17*a* the refrigerant liquid flows through throttle means comprising orifice plates 28*a* and into chamber 5*b*, through distribution means 24 and 25. A portion of the liquid flashes as it reaches the lower pressure chamber 5*b*, further cooling the remaining refrigerant liquid. As the mixture of liquid and flash gas flows into chamber 5*b*, the liquid is separated from the vapor as explained above. Returning motor coolant refrigerant (which is a mixture of vapor and liquid) enters chamber 5*b* at inlet 18, mixes with the liquid and flash gas downstream of orifice plates 27*a*, and in combination, flow through distribution plate holes 25*a*.

In chamber 5*b*, the flash gas is separated from the liquid spray as in chamber 5*a*, flows through baffle means 27 and out to mix with the refrigerant vapor from the outlet 11*b* of compressor stage 7*a*, and enters inlet 12*a* of intermediate compressor stage 7*b*. Again, it should be apparent that the pressure at the inlet 12*a* is approximately the same but slightly less than the pressure in chamber 5*b*. The remaining cooled refrigerant liquid flows out of the economizer past vortex breaker plate 26, through first outlet means 19, and thereafter through the throttle means 14 to the evaporator 10.

Figure 5:
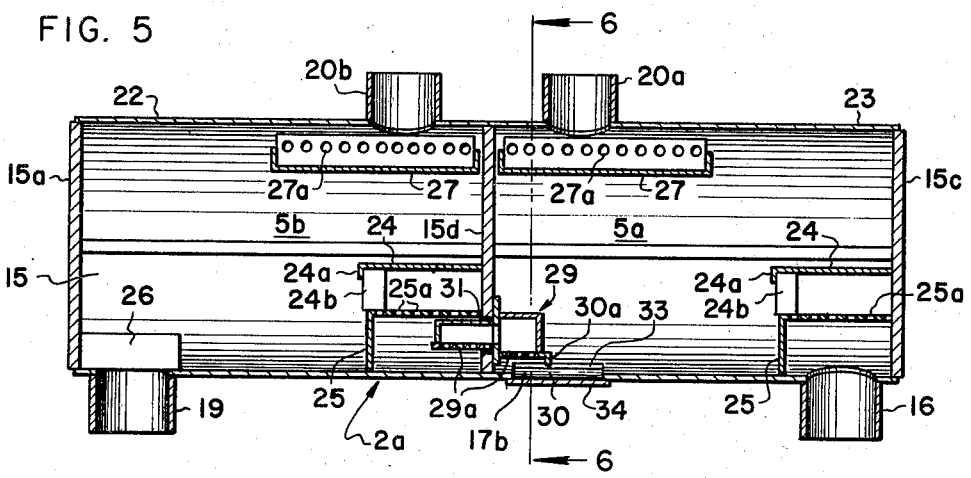
FIG. 5 is a cross-sectional view taken along the longitudinal axis of the second embodiment of the present invention.
Figure 6:
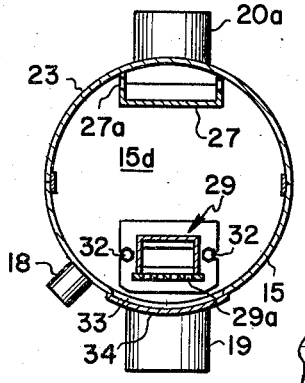
FIG. 6 is a transverse cross-sectional view taken along section lines 6—6 of FIG. 5.
Figure 7:
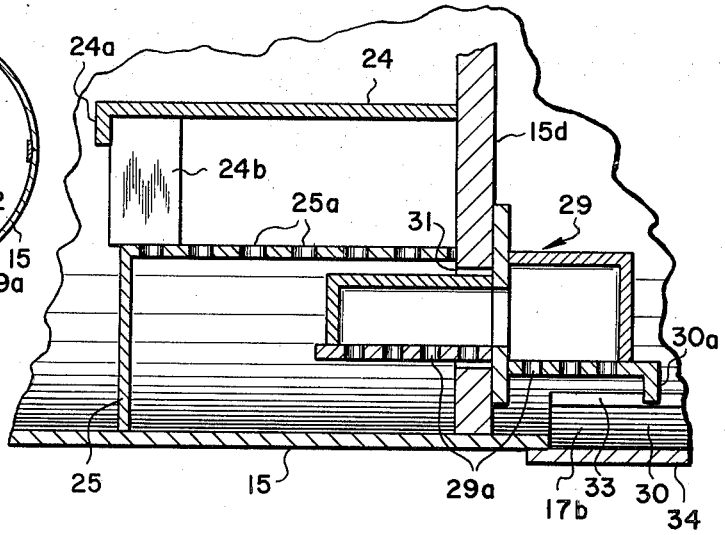
FIG. 7 is an expanded portion of a cross-sectional view, showing details of the economizer of FIG. 5, specifically of that part whereby refrigerant is conveyed between stages.

The second embodiment of the present invention is shown in FIGS. 5–7. For convenience, the same reference numerals are used to identify elements common to both first and second embodiments. The second embodiment, generally denoted by referece numeral 2*a*, is connected into a refrigeration system in the same manner as shown for the first embodiment. A significant difference between the two exists in the manner in which the refrigerant liquid flows from chamber 5*a* to chamber 5*b*, and particularly with the structure of the connecting means, sump means, and throttle means at that point, as hereinafter explained.

In economizer 2*a*, connecting means 29 extend through second inlet means 31 in center partition means 15*d*, beneath the perforated surface of distribution plate 25 in chamber 5*b*. The second outlet means 30 is formed between a downward distended lip 30*a* of connecting means 29 and the bottom inside of chamber 50. Sump means 17*b* are disposed immediately below connecting means 29, in chamber 5*a*. Throttle means comprising orifice plates 29*a* are operative to partially restrict the flow of refrigerant and maintain a pressure drop between chambers 5*a* and 5*b* in much the same manner as orifice plates 28*a* are in the first embodiment.

It is anticipated that economizer 2*a* would be equally capable of operation over a wide cooling range by utilizing orifice plates 29*a* having perforations of different diameter or number. Connecting means 29 with the appropriate orifice plates 29*a* could therefore be installed after the economizer 2*a* were otherwise complete through an access hole 33 in the bottom of chamber 5*a*. After attaching connecting means 29 to partition means 15*d* with bolts 32 or other appropriate means, the access hole 33 would be sealed with a metal plate 34, welded or otherwise suitably held in place.

Economizer 2*a* operates in an analogous fashion to economizer 2. Refrigeration liquid and flash gas are separated upon entry into chamber 5*a* of economizer 2*a* as explained above for the first embodiment. The refrigerant liquid thereafter flows through second outlet means 30 and collects in sump means 17*b*. Lip 30*a* effects at least a partial vapor seal with liquid at the bottom of chamber 5*a* and in sump means 17*b*, thereby minimizing flash gas blow by. Part of the refrigerant liquid flashes as it passes through orifice plates 29*a*, thereby further cooling the remaining liquid. In all other aspects, the operation of the second embodiment are as previously explained for the first embodiment.

Freon 11 would be used as the refrigerant in the invention as disclosed. It should be clear that the subject invention could be used with other refrigerant fluids with equally beneficial results. Likewise, it is evident that additional stages of economizer action might be added to achieve higher efficiency of the refrigeration system, however, because the percentage increase in efficiency declines with each additional stage, this may not be economical. It is principally through the reduction of the cost of construction, efficient design, and energy savings gained that the two stage economizer disclosed hereinabove is made practical of use, compared to the prior art.

While the invention has been described with respect to a preferred embodiment, it is to be understood that modifications thereto will be apparent to those skilled in the art within the scope of the invention, as defined in the claims which follow.

We claim:

1. An economizer having a pluraity of stages for flash cooling refrigerant liquid for use in a refrigeration system comprising a. housing means defining a plurality of chambers of successively lower pressure, a first chamber being at the highest pressure, and a last chamber at the lowest pressure;

b. first inlet means for conveying refrigerant liquid into said first chamber which is at the highest pressure;

c. first outlet means for conveying the cooled refrigerant liquid out of said last chamber which is at the lowest pressure;

d. second inlet means for conveying refrigerant into each of the chambers except said first chamber;

e. second outlet means for conveying cooled refrigerant predominantly in the liquid stage, out from each of the chambers except said last chamber;

f. connecting means for connecting the second outlet means of a chamber of relatively higher pressure together in fluid communication with the second inlet means of a chamber of successively lower pressure, said connecting means including sump means for collecting the cooled refrigerant liquid which flows through said connecting means;

g. throttling means for restricting the flow of refrigerant into each chamber and thereby reducing its pressure such that a portion of the refrigerant liquid flashes or evaporates as it flows through said throttling means, and thereby cools the liquid refrigerant remaining; and h. flash gas outlet means disposed near the top of each chamber, and operative to convey flash gas away from that chamber.

2. The economizer of claim 1 wherein said chambers are generally of elongated form and arranged in abutting relationship along a common longitudinal axis.

3. The economizer of claim 2 wherein said housing means are cylindrical in shape.

4. The economizer of claim 3 wherein said housing means include longitudinal sections of a cylinder forming the top of each chamber with flash gas outlet means attached thereto in a position, such that said top sections of adjacent chambers, relative to the position of said flash gas outlet means, are symmetrically opposite.

5. The economizer of claim 2 wherein said sump means are disposed inside each chamber near its bottom, and wherein the throttling means restricting the flow of refrigerant into all of the chambers except said first chamber are disposed therein so as to restrict the flow of refrigerant through said connecting means.

6. The economizer of claim 5 wherein said throttling means are disposed within said connecting means so that they effect at least a partial vapor seal with the refrigerant liquid collected in the sump means, and thereby minimize refrigerant vapor bypass through said throttling means.

7. The economizer of claim 6 wherein said housing means include partition means extending transversely to the longitudinal axis, for defining the ends of said chambers, said partition means being common to the adjacent abutting chambes and having said connecting means disposed in the lower portion of said common partition means and extending therethrough.

8. The economizer of claim 2 wherein said sump means depend below said housing means, are generally of rectangular configuration, and are sealingly attached to said housing means in enclosing relationship around the second inlet means and the second outlet means of adjacent chambers.

9. The economizer of claim 8 wherein said housing means include partition means extending transversely to the longitudinal axis, for defining the ends of said chambers, said partition means being common to the adjacent abutting chambers; and wherein said second inlet means and said second outlet means of the adjacent abutting chambers are disposed on opposite sides of the common partition means with said sump means in underlying relationship.

10. The economizer of claim 9 wherein said throttling means restricting the flow of refrigerant into all of the chambers except said first chamber are disposed within said second inlet means, said second inlet means extending down into said sump means so that they effect at last a partial vapor seal with the refrigerant liquid collected therein, and thereby minimize refrigerant vapor bypass through said throttling means.

11. The economizer of claim 1 further comprising distributor means disposed above the first and the second inlet means, for directing the entering flow of the refrigerant liquid/vapor mixture downstream of said throttling means, into the interior of each chamber in a generally horizontal direction.

12. The economizer of claim 11 wherein said distributor means include in each chamber a deflector plate having at least one edge turned down into the flow path of the refrigerant liquid/vapor mixture, for deflecting said mixture and thereby causing efficient separation of the refrigerant vapor from the resulting liquid spray.

13. The economizer of claims 1, 7, 10, or 12 further comprising baffle means disposed below the flash gas outlet means of each chamber, for further reducing the entrainment of the refrigerant liquid in the refrigerant vapor flowing through said flash gas outlet means by spreading out the area over which the flash gas is collected and thereby reducing its flow velocity toward the top of the chamber, exterior to the baffle means.

14. The economizer of claim 13 wherein said baffle means in each chamber include a generally rectangular shaped structure having a plurality of openings on its sides, such that the flash gas flows toward said openings at a relatively low velocity compared to its flow velocity through said flash gas outlet means, and thereby minimizes carryover of droplets of refrigerant liquid into said baffle means.

15. The economizer of claim 1 wherein said throttling means include plates having a plurality of orifices of sufficiently small diameter to substantially restrict the flow of refrigerant therethrough, within predetermined limits.

* * * * *